US010077680B2

(12) United States Patent
Thibodeau et al.

(10) Patent No.: US 10,077,680 B2
(45) **Date of Patent: *Sep. 18, 2018**

(54) BLADE OUTER AIR SEAL ASSEMBLY AND SUPPORT

(71) Applicant: United Technologies Corporation, Hartford, CT (US)

(72) Inventors: Anne-Marie B. Thibodeau, Winslow, ME (US); Bruce E. Chick, Strafford, NH (US); Thurman Carlo Dabbs, Dover, NH (US); James N. Knapp, Sanford, ME (US); Dmitriy A. Romanov, Wells, ME (US); Russell E. Keene, Arundel, ME (US); Jeffrey Vincent Anastas, Kennebunk, ME (US)

(73) Assignee: United Technologies Corporation, Farmington, CT (US)

( * ) Notice: Subject to any disclaimer, the term of this patent is extended or adjusted under 35 U.S.C. 154(b) by 711 days.

This patent is subject to a terminal disclaimer.

(21) Appl. No.: 14/504,719

(22) Filed: Oct. 2, 2014

(65) Prior Publication Data

US 2015/0016954 A1 Jan. 15, 2015

Related U.S. Application Data

(63) Continuation of application No. 13/012,845, filed on Jan. 25, 2011, now Pat. No. 8,876,458.

(51) Int. Cl.

| | |
|---|---|
| ***F01D 11/08*** | (2006.01) |
| ***F01D 25/24*** | (2006.01) |
| ***F01D 11/12*** | (2006.01) |

(52) U.S. Cl.

CPC ..... *F01D 25/246* (2013.01); *F01D 11/08* (2013.01); *F01D 11/125* (2013.01); *F05D 2240/11* (2013.01); *F05D 2260/202* (2013.01)

(58) Field of Classification Search

CPC ..... F01D 11/08; F01D 11/12; F01D 11/125; F01D 11/122; F01D 11/127; F01D 25/246

See application file for complete search history.

(56) References Cited

U.S. PATENT DOCUMENTS 4,157,232 A 6/1979 Bobo et al.
4,303,371 A 12/1981 Eckert
(Continued)

FOREIGN PATENT DOCUMENTS

EP 1024251 A2 8/2000
EP 1323983 A2 7/2003
(Continued)

OTHER PUBLICATIONS

European Search Report for European Application No. 12151619.9.

*Primary Examiner* — Justin Seabe
(74) *Attorney, Agent, or Firm* — Carlson, Gaskey & Olds, P.C.

(57) ABSTRACT

An blade outer air seal support assembly includes a main support member configured to support a blade outer air seal. The main support member extends generally axially between a leading edge portion and a trailing edge portion. The leading edge portion is configured to be slidably received within a groove established by the blade outer air seal. A support tab extends radially inward from the main support member toward the blade outer air seal. The support tab configured to contact an extension of the blade outer air seal to limit relative axial movement of the blade outer air seal. A gusset spans between the support tab and the main support member.

22 Claims, 3 Drawing Sheets

(56) References Cited

U.S. PATENT DOCUMENTS

| | | | | |
|---|---|---|---|---|
| 5,092,735 | A | 3/1992 | Katy et al. | |
| 5,197,853 | A | 3/1993 | Creevy et al. | |
| 5,375,973 | A | 12/1994 | Sloop et al. | |
| 5,423,659 | A | 6/1995 | Thompson | |
| 5,609,469 | A | 3/1997 | Worley et al. | |
| 5,649,806 | A | 7/1997 | Scricca et al. | |
| 5,993,150 | A * | 11/1999 | Liotta | F01D 11/10 415/115 |
| 6,155,778 | A | 12/2000 | Lee et al. | |
| 6,196,792 | B1 * | 3/2001 | Lee | F01D 11/08 415/116 |
| 6,467,339 | B1 | 10/2002 | Descoteaux et al. | |
| 7,306,424 | B2 | 12/2007 | Romanov et al. | |
| 7,473,073 | B1 | 1/2009 | Liang | |
| 7,553,128 | B2 | 6/2009 | Abdel-Messeh et al. | |
| 7,665,962 | B1 | 2/2010 | Liang | |
| 7,704,039 | B1 | 4/2010 | Liang | |
| 7,722,315 | B2 | 5/2010 | Lee et al. | |
| 7,763,356 | B2 | 7/2010 | Berczik et al. | |
| 7,993,097 | B2 * | 8/2011 | Amiot | F01D 9/04 415/116 |
| 2007/0025837 | A1 | 2/2007 | Pezzetti, Jr. et al. | |
| 2007/0248462 | A1 | 10/2007 | Lutjen et al. | |
| 2008/0124214 | A1 | 5/2008 | Lutjen et al. | |
| 2008/0145643 | A1 | 6/2008 | Reynolds et al. | |
| 2008/0211192 | A1 | 9/2008 | Pietraszkiewicz et al. | |
| 2009/0067994 | A1 | 3/2009 | Pietraszkiewicz et al. | |
| 2009/0269190 | A1 | 10/2009 | Wunderlich et al. | |
| 2010/0021716 | A1 | 1/2010 | Strock et al. | |
| 2010/0074745 | A1 | 3/2010 | Jones et al. | |

FOREIGN PATENT DOCUMENTS

| | | | |
|---|---|---|---|
| EP | 1431405 | | 6/2004 |
| EP | 1676981 | A2 | 7/2006 |
| EP | 1762705 | A1 | 3/2007 |
| EP | 1887191 | A2 | 2/2008 |
| EP | 1965033 | A2 | 9/2008 |
| EP | 1990507 | A1 | 11/2008 |
| EP | 2166194 | A2 | 3/2010 |
| GB | 2104965 | A | 3/1983 |
| JP | 2010001764 | A | 1/2010 |
| WO | 2008128876 | A1 | 10/2008 |

* cited by examiner

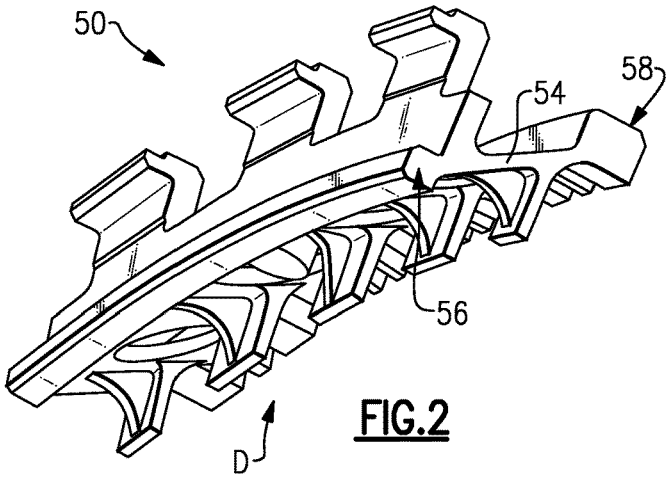
FIG.2
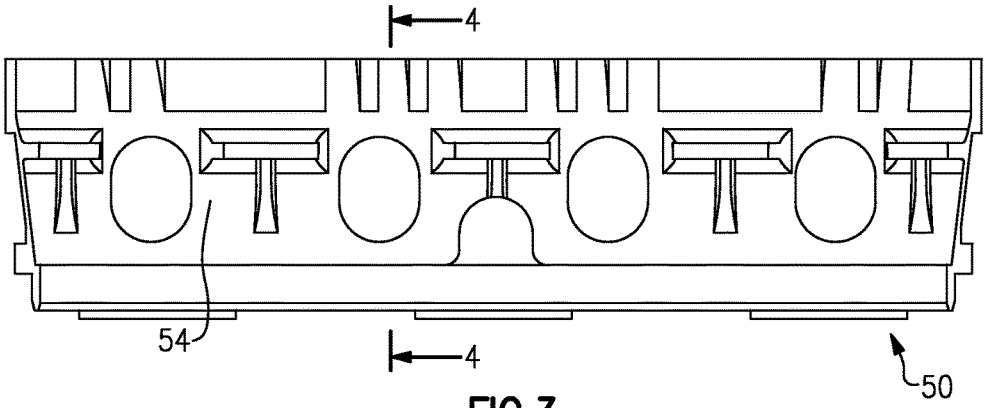
FIG.3
FIG.4
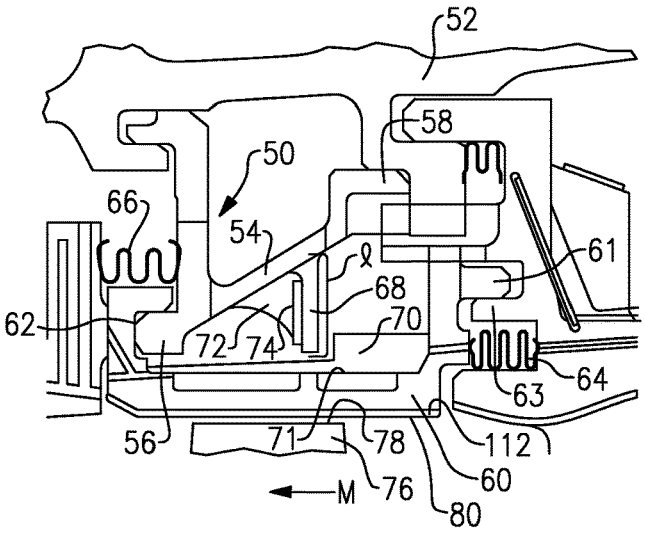

BLADE OUTER AIR SEAL ASSEMBLY AND SUPPORT

CROSS-REFERENCE TO RELATED APPLICATIONS

This application is a continuation of U.S. patent application Ser. No. 13/012,845, which was filed on 25 Jan. 2011 and is incorporated herein by reference.

BACKGROUND

This disclosure relates generally to a blade outer air seal and, more particularly, to enhancing the performance of a blade outer air seal and surrounding structures.

As known, gas turbine engines, and other turbomachines, include multiple sections, such as a fan section, a compressor section, a combustor section, a turbine section, and an exhaust section. Air moves into the engine through the fan section. Airfoil arrays in the compressor section rotate to compress the air, which is then mixed with fuel and combusted in the combustor section. The products of combustion are expanded to rotatably drive airfoil arrays in the turbine section. Rotating the airfoil arrays in the turbine section drives rotation of the fan and compressor sections.

A blade outer air seal arrangement includes multiple blade outer air seals circumferentially disposed about at least some of the airfoil arrays. The tips of the blades within the airfoil arrays seal against the blade outer air seals during operation. Improving and maintaining the sealing relationship between the blades and the blade outer air seals enhances performance of the turbomachine. As known, the blade outer air seal environment is exposed to temperature extremes and other harsh environmental conditions, both of which can affect the integrity of the blade outer air seal and the sealing relationship.

SUMMARY

A blade outer air seal support assembly according to an exemplary aspect of the present disclosure includes, among other things, a main support member configured to support a blade outer air seal. The main support member extends generally axially between a leading edge portion and a trailing edge portion. The leading edge portion is configured to be slidably received within a groove established by the blade outer air seal. A support tab extends radially inward from the main support member toward the blade outer air seal. The support tab configured to contact an extension of the blade outer air seal to limit relative axial movement of the blade outer air seal. A gusset spans between the support tab and the main support member.

In a further non-limiting embodiment of the foregoing blade outer air seal, the blade outer air seal includes, an interface between the gusset and the support tab has an interface length, and a ratio of the interface length to a radial length of the support tab is about 2 to 3.

In a further non-limiting embodiment of any of the foregoing blade outer air seals, the blade outer air seal includes, a main support member that includes an extension configured to be received with a groove established within the blade outer air seal. The extension has a radially outwardly facing surface configured to contact a portion of the blade outer air seal to limit radial movement of the blade outer air seal relative to the main support member when the blade outer air seal is in an installed position relative to the main support member.

In a further non-limiting embodiment of the foregoing blade outer air seal, the groove is established near a leading edge portion of the blade outer air seal.

In a further non-limiting embodiment of the foregoing blade outer air seal, the support tab is configured to contain a blade during a blade-out event.

In a further non-limiting embodiment of the foregoing blade outer air seal, the support tab is axially aligned with a blade path area of the blade outer air seal.

In a further non-limiting embodiment of the foregoing blade outer air seal, the entire support tab is positioned upstream from the trailing edge portion.

A method of film cooling utilizing a blade outer air seal according to another exemplary aspect of the present disclosure includes, among other things, providing an inwardly facing surface of a blade outer air seal. The inwardly facing surface has a blade path area and a peripheral area different than the blade path area. The entire blade path area and the entire peripheral area being radially aligned. The method includes directing cooling air through a plurality of apertures established in the inwardly facing surface. The plurality of apertures are concentrated in the blade path area.

In a further non-limiting embodiment of the foregoing method, the method further comprises providing the plurality of apertures exclusively within the blade path area.

In a further non-limiting embodiment of any of the foregoing methods, the blade path area and the peripheral area are parallel to an axis of a gas turbine engine.

In a further non-limiting embodiment of any of the foregoing methods, the method further comprises supporting the blade outer air seal with a main support member, the main support member extending generally axially between a leading edge portion and a trailing edge portion, the leading edge portion slidably received within a groove established by the blade outer air seal.

In a further non-limiting embodiment of any of the foregoing methods, the method further comprises contacting a support tab extending radially inward from the main support member against an extension of the blade outer air seal to limit relative axial movement of the blade outer air seal.

In a further non-limiting embodiment of any of the foregoing methods, the entire support tab is positioned upstream from the trailing edge portion.

In a further non-limiting embodiment of any of the foregoing methods, the support tab is axially aligned with the blade path area.

In a further non-limiting embodiment of any of the foregoing methods, the method includes supporting the support tab relative to the main support member using a gusset spanning between the support tab and the main support member.

A blade outer air seal assembly according to yet another exemplary aspect of the present disclosure includes, among other things, a blade outer air seal assembly having a inwardly facing surface, a blade path portion of the inwardly facing surface that is axially aligned with a tip of a rotating blade, and a peripheral portion of the inwardly facing surface that is located axially in front of the blade path portion, axially behind the blade path portion, or both. The peripheral portion and the blade path portion are radially aligned. The blade outer air seal assembly establishes cooling paths that terminate at a plurality of apertures established within the inwardly facing surface. The plurality of apertures are located exclusively within the blade path portion.

In a further non-limiting embodiment of the foregoing blade outer air seal, the peripheral portion is unapertured.

In a further non-limiting embodiment of any of the foregoing blade outer air seals, the inwardly facing surface includes a layer of bond coat.

In a further non-limiting embodiment of any of the foregoing blade outer air seals, a thickness of the layer of bond coat is at least 10 millimeters.

In a further non-limiting embodiment of any of the foregoing blade outer air seals, the blade outer air seal assembly is distributed annularly about an axis of rotation of a gas turbine engine, and the entire blade path portion and the entire peripheral portion are parallel to the axis.

These and other features of the disclosed examples can be best understood from the following specification and drawings, the following of which is a brief description.

BRIEF DESCRIPTION OF THE FIGURES

FIG. 2 shows a perspective view of a blade outer air seal support assembly from the low pressure compressor section of the FIG. 1 turbomachine.

FIG. 3 shows a view of the FIG. 2 support assembly in direction D.

FIG. 4 shows a section view at line 4-4 in FIG. 3 of the support assembly within the low pressure compressor section of the FIG. 1 turbomachine.

DETAILED DESCRIPTION

Figure 1:
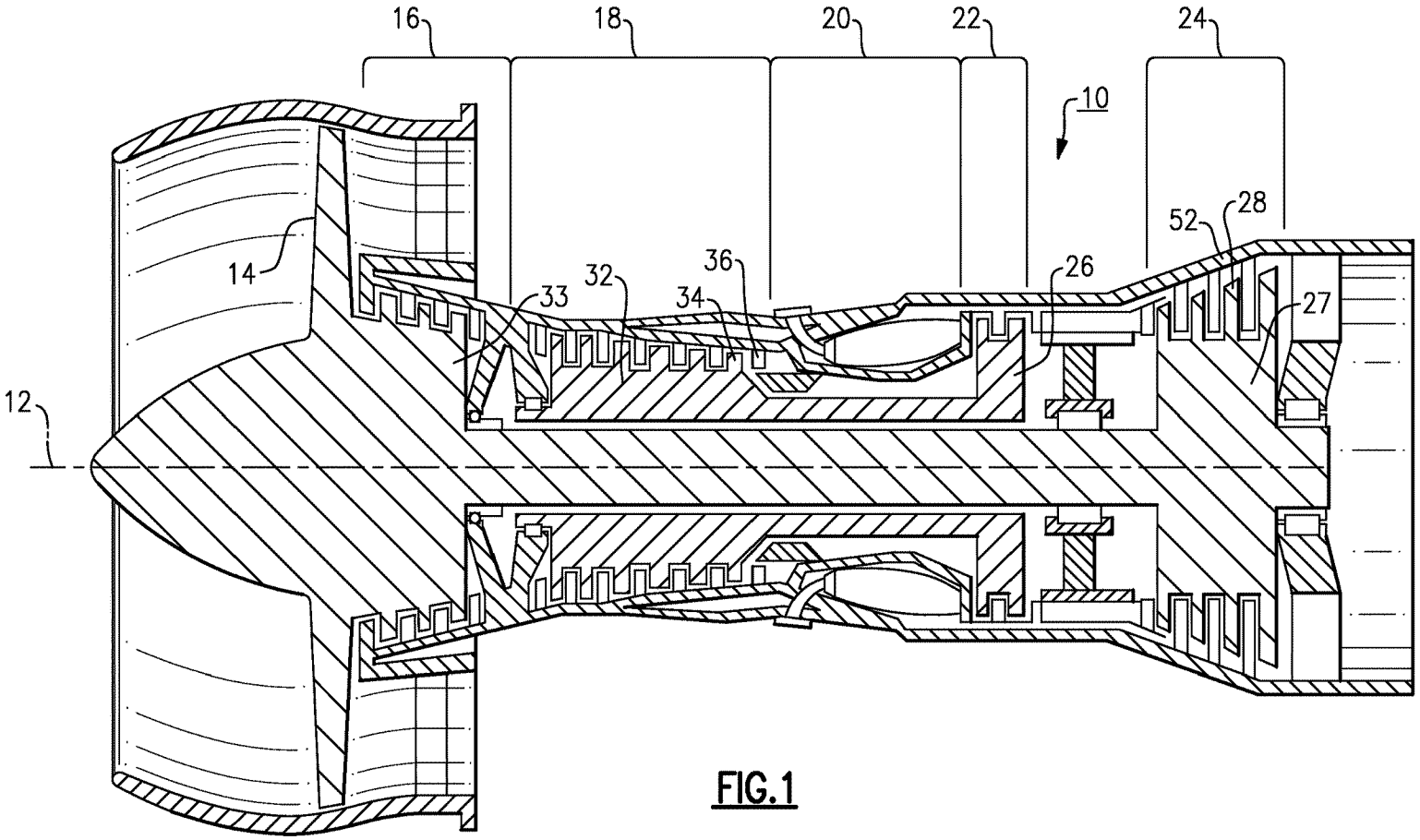
FIG. 1 shows a cross-section of an example turbomachine.

Referring to FIG. 1, an example turbomachine, such as a gas turbine engine 10, is circumferentially disposed about an axis 12. The gas turbine engine 10 includes a fan 14, a low pressure compressor section 16, a high pressure compressor section 18, a combustion section 20, a high pressure turbine section 22, and a low pressure turbine section 24. Other example turbomachines may include more or fewer sections.

During operation, air is compressed in the low pressure compressor section 16 and the high pressure compressor section 18. The compressed air is then mixed with fuel and burned in the combustion section 20. The products of combustion are expanded across the high pressure turbine section 22 and the low pressure turbine section 24.

The high pressure compressor section 18 and the low pressure compressor section 16 include rotors 32 and 33, respectively, that rotate about the axis 12. The high pressure compressor section 18 and the low pressure compressor section 16 also include alternating rows of rotating airfoils or rotating compressor blades 34 and static airfoils or static vanes 36.

The high pressure turbine section 22 and the low pressure turbine section 24 each include rotors 26 and 27, respectively, which rotate in response to expansion to drive the high pressure compressor section 18 and the low pressure compressor section 16. The rotors are rotating arrays of blades 28, for example.

The examples described in this disclosure are not limited to the two spool gas turbine architecture described, however, and may be used in other architectures, such as the single spool axial design, a three spool axial design, and still other architectures. That is, there are various types of gas turbine engines, and other turbomachines, that can benefit from the examples disclosed herein.

Referring to FIGS. 2-4, an example blade outer air seal (BOAS) support structure 50 is suspended from an outer casing 52 of the gas turbine engine 10. In this example, the BOAS support structure 50 is located within the low pressure turbine section 24 of the gas turbine engine 10.

The BOAS support structure 50 includes a main support member 54 that extends generally axially from a leading edge portion 56 to a trailing edge portion 58. The BOAS support structure 50 is configured to support a BOAS assembly 60 relative to the outer casing 52. The example BOAS support structure 50 is configured to support a second BOAS assembly (not shown). The BOAS support structure 50 is made of WASPALLOY® material, but other examples may include other types of material.

In this example, the BOAS 60 establishes a groove 62 that receives the leading edge portion 56 of the BOAS support structure 50. The leading edge portion 56 includes an extension that is received within the groove 62 when the BOAS 60 is in an installed position. A radially outwardly facing surface of the extension contacts a portion of the BOAS 60 to limit radial movement of the BOAS 60 relative to the BOAS support structure 50. The trailing edge portion 58 of the example BOAS 60 does not engage with the BOAS support structure 50. The trailing edge portion 58 has a hook 61 that is supported by a structure 63 associated with the number two vane in the low pressure turbine section 24.

Springs 64 and 66 help hold the position of the BOAS 60 relative to the BOAS support structure 50. Specifically, the springs 64 and 66 help hold the leading edge portion 56 within the groove 62, and this hook 61 in a position that is supported by the structure 63.

In this example, a support tab 68 extends radially from the main support member 54 toward the BOAS 60. The support tab 68 is positioned to limit relative axial movement of the BOAS 60 relative to the BOAS support structure 50. The movement is represented by arrow M in FIG. 4.

To limit such movement, the support tab 68 blocks movement of an extension 70 that extends radially outward from an outwardly facing surface 71 of the BOAS 60. Limiting axial movement of the BOAS 60 relative to the BOAS support structure 50 facilitates maintaining the leading edge portion 56 of the BOAS support structure 50 within the groove 62 of the BOAS 60. Support tab 68 also provides containment in the event of a blade out event.

A gusset 72 spans from the main support member 54 to the support tab 68. The gusset 72 contacts the support tab 68 at an interface 74. Notably, the interface 74 is about two-thirds the length L of the support tab 68. The length L represents the length that the support tab 68 extends from the main support member 54.

The gusset 72 enhances the robustness of the support tab 68 and lessens vibration of the support tab 68. In effect, the gusset 72 improves the dynamic responses of the BOAS support structure 50.

The example BOAS support structure 50 holds the BOAS 60 in a position appropriate to interface with a blade 76 of the high pressure turbine rotor 27. As known, a tip 78 of the blade 76 seals against an inwardly facing surface 80 of the BOAS 60 during operation of the gas turbine engine 10.

Figure 5:
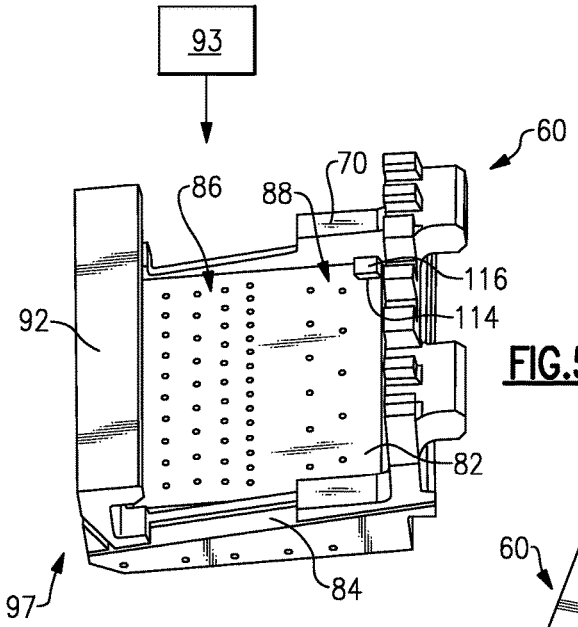
FIG. 5 shows a perspective view of the FIG. 4 blade outer air seal from the outwardly facing surface.
Figure 6:
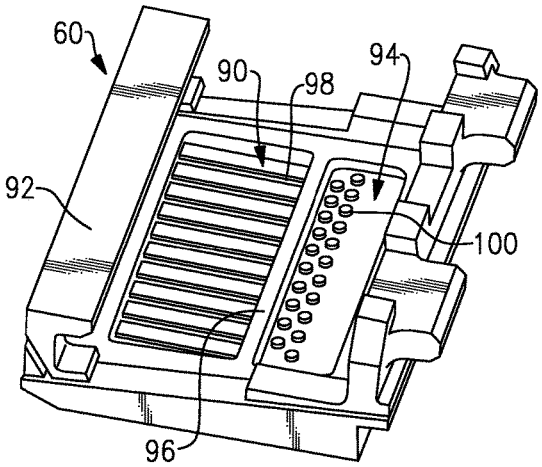
FIG. 6 shows a main body portion of the FIG. 5 blade outer air seal, prior to the welding on of the impingement plate.
Figure 7:
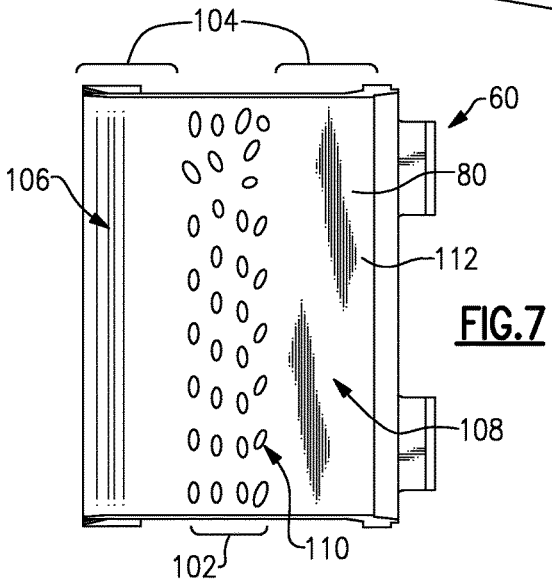
FIG. 7 shows an inwardly facing surface of the FIG. 6 blade outer air seal.

Referring to FIGS. 5-7 with continuing reference to FIG. 4, an example BOAS 60 includes features that communicate thermal energy away from the BOAS 60. One such feature is an impingement plate 82 that, in this example, is welded directly to an outwardly directed surface 84 of the BOAS 60.

The example impingement plate 82 establishes a first plurality of apertures 86 and a second plurality of apertures 88 that is less dense than the first plurality of apertures 86. The first plurality of apertures 86 is configured to communicate a cooling airflow through the impingement plate 82 to a forward cavity 90 established by a main body portion 92 of the BOAS 60 and the impingement plate 82. The second plurality of apertures 88 is configured to communicate a flow of cooling air to an aft cavity 94 established within the main body portion 92 and the impingement plate 82. The cooling air moves to the impingement plate 82 from a cooling air supply 93 that is located radially outboard from the BOAS 60. A person having skill in this art, and the benefit of this disclosure, would understand how to move cooling air to the BOAS 60 within the gas turbine engine 10.

The main body portion 92 establishes a dividing rib 96 that separates the forward cavity 90 from the aft cavity 94. As can be appreciated, the forward cavity 90 is positioned axially closer to a leading edge 97 of the BOAS 60 than the aft cavity 94.

In this example, the main body portion 92 establishes a plurality of ribs 98 disposed on a floor of the forward cavity 90. The ribs 98 are axially aligned (with the axis 12 of FIG. 1). The main body portion 92 also establishes a plurality of depto warts 100 on a floor of the aft cavity 94. The ribs 98 and the depto warts 100 increase the surface area of the main body portion 92 that is directly exposed to the flow of air moving through the impingement plate 82. The ribs 98 and the depto warts 100 thus facilitate thermal energy transfer away from the main body portion 92 of the BOAS 60. In this example, the main body portion 92 is cast from a single crystal alloy. The ribs 98 facilitate casting while maintaining thermal energy removal capability.

The blade tip 78 interfaces with the inwardly facing surface 80 of the BOAS 60 along a blade path portion 102 of the inwardly facing surface. A peripheral portion 104 of the inwardly facing surface 80 represents the areas of the inwardly facing surface 80 located outside the blade path portion 102. In this example, the peripheral portion 104 includes a first portion 106 located near the leading edge of the BOAS 60 and a second portion 108 located near the trailing edge of the BOAS 60.

The inwardly facing surface 80 establishes a plurality of apertures 110. Conduits extending from the cavities 90 and 94 deliver air through the main support member 92 to the apertures 110. In this example, all the apertures 110 are located within the blade path portion 102. That is, the apertures 110 are located exclusively within the blade path portion 102 of the inwardly facing surface. The peripheral portions 104 are unapertured in this example.

The inwardly facing surface 80 includes a layer of bond coat 112 that is about 10 millimeters (0.39 inches) thick in this example. The increased thickness of the bond coat 112 over previous designs helps increase the oxidation life of the BOAS 60.

The example impingement plate 82 includes a cutout area 114 designed to receive a feature 116 extending from the main body portion 92. During assembly, the feature 116 aligns to the cutout area 114 preventing misalignment of the impingement plate 82 relative to the main body portion 92. The impingement plate 82 is a cobalt alloy in this example.

Features of the disclosed embodiment include targeting film cooling within the inwardly facing surface of the BOAS to more effectively and uniformly communicate thermal energy away from the BOAS and the tip of the rotating blade. The targeted film cooling dedicates cooling air more efficiently than prior art designs.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

We claim:

1. A blade outer air seal support assembly, comprising:

a main support member configured to support a blade outer air seal, the main support member extending generally axially between a leading edge portion and a trailing edge portion, the leading edge portion configured to be slidably received within a groove established by the blade outer air seal, the groove opening toward the trailing edge portion of the main support member;

a support tab extending radially inward from the main support member toward the blade outer air seal, the support tab configured to contact an extension of the blade outer air seal to limit relative axial movement of the blade outer air seal, the support tab axially aligned with a blade path portion of the blade outer air seal, the support tab extending radially inward relative to both the leading edge portion and the trailing edge portion; and a gusset spans between the support tab and the main support member.

2. The blade outer air seal support assembly of claim 1, wherein an interface between the gusset and the support tab has an interface length, and a ratio of the interface length to a radial length of the support tab is about 2 to 3.

3. The blade outer air seal support assembly of claim 1, wherein an extension of the main support member is configured to be received within the groove established within the blade outer air seal, the extension having a radially outwardly facing surface configured to contact a portion of the blade outer air seal to limit radial movement of the blade outer air seal relative to the main support member when the blade outer air seal is in an installed position relative to the main support member.

4. The blade outer air seal support assembly of claim 3, wherein the groove is established near the leading edge portion of the blade outer air seal.

5. The blade outer air seal support assembly of claim 1, wherein the support tab is configured to contain a blade during a blade-out event.

6. The blade outer air seal support assembly of claim 1, wherein the support tab is axially aligned with a blade path area of the blade outer air seal.

7. The blade outer air seal support assembly of claim 1, wherein the entire support tab is positioned upstream from the trailing edge portion.

8. The blade outer air seal support assembly of claim 1, a main body portion of a blade outer air seal having an outwardly facing surface and an inwardly facing surface;

an impingement plate directly adjacent the outwardly facing surface of the main body portion;

a plurality of elongated ribs disposed between the impingement plate and the main body portion; and a plurality of depto warts disposed between the impingement plate and the main body portion, the plurality of elongated ribs positioned axially closer to a leading edge portion of the blade outer air seal than the plurality of depto warts.

9. A method of film cooling utilizing a blade outer air seal comprising:

providing an inwardly facing surface of a blade outer air seal, the inwardly facing surface having a blade path area and a peripheral area different than the blade path area, the entire blade path area and the entire peripheral area being radially aligned;

directing cooling air through a plurality of apertures established in the inwardly facing surface, wherein the plurality of apertures are concentrated in the blade path area;

supporting the blade outer air seal with a main support member, the main support member extending generally axially between a leading edge portion and a trailing edge portion, the leading edge portion slidably received within a groove established by the blade outer air seal; and contacting a support tab extending radially inward from the main support member against an extension of the blade outer air seal to limit axial movement of the leading edge portion out of the groove, the support tab extending radially inward relative to both the leading edge portion and the trailing edge portion, the contacting at a position that is radially inside both the leading edge portion and the trailing edge portion.

10. The method of film cooling of claim 9, further comprising providing the plurality of apertures exclusively within the blade path area.

11. The method of film cooling of claim 9, wherein the blade path area and the peripheral area are parallel to an axis of a gas turbine engine.

12. The method of film cooling of claim 9, wherein the entire support tab is positioned upstream from the trailing edge portion.

13. The method of film cooling of claim 9, wherein the support tab is axially aligned with the blade path area.

14. The method of film cooling of claim 9, supporting the support tab relative to the main support member using a gusset spanning between the support tab and the main support member.

15. A method of film cooling of claim 9, further comprising providing a plurality of depto warts and a plurality of elongated ribs within a cavity between an impingement plate and a main body portion of a blade outer air seal, the impingement plate directly adjacent the main body portion, the plurality of elongated ribs positioned axially closer to a leading edge portion of the blade outer air seal than the plurality of depto warts.

16. The method of film cooling of claim 15, including providing the plurality of apertures exclusively within the blade path area.

17. The method of film cooling of claim 15, wherein the blade path area and the peripheral area are parallel to an axis of a gas turbine engine.

18. A blade outer air seal assembly, comprising:

a blade outer air seal assembly having a inwardly facing surface;

a blade path portion of the inwardly facing surface that is axially aligned with a tip of a rotating blade;

a peripheral portion of the inwardly facing surface that is located axially in front of the blade path portion, axially behind the blade path portion, or both, wherein the peripheral portion and the blade path portion are radially aligned, wherein the blade outer air seal assembly establishes cooling paths that terminate at a plurality of apertures established within the inwardly facing surface, and the plurality of apertures are located exclusively within the blade path portion;

a main support member configured to support the blade outer air seal, the main support member extending generally axially between a leading edge portion and a trailing edge portion, the leading edge portion configured to be slidably received within a groove established by the blade outer air seal; and a support tab extending radially inward from the main support member toward the blade outer air seal, the support tab configured to contact an extension of the blade outer air seal to limit relative axial movement of the leading edge portion from within the groove, the support tab extending radially inward relative to both the leading edge portion and the trailing edge portion, the support tab configured to contact the extension at a position that is radially inside both the leading edge portion and the trailing edge portion.

19. The blade outer air seal of claim 18, wherein the peripheral portion is unapertured.

20. The blade outer air seal of claim 18, wherein the inwardly facing surface includes a layer of bond coat.

21. The blade outer air seal of claim 20, wherein a thickness of the layer of bond coat is at least 10 millimeters (0.39 inches).

22. The blade outer air seal of claim 18, wherein the blade outer air seal assembly is distributed annularly about an axis of rotation of a gas turbine engine, and the entire blade path portion and the entire peripheral portion are parallel to the axis.

* * * * *